United States Patent [19]

Raque et al.

[11] Patent Number: 4,498,358

[45] Date of Patent: Feb. 12, 1985

[54] OSCILLATING HEAD FILLER DEVICE

[75] Inventors: Glen F. Raque; Edward A. Robinson, both of Louisville, Ky.

[73] Assignee: Raque Food Systems Inc., Louisville, Ky.

[21] Appl. No.: 304,619

[22] Filed: Sep. 22, 1981

[51] Int. Cl.[3] ..... F16H 35/08; B65B 43/42

[52] U.S. Cl. ..... 74/829; 141/135; 141/137

[58] Field of Search ..... 74/829, 37, 67, 68; 141/135, 136, 137

[56] References Cited

U.S. PATENT DOCUMENTS 1,992,464 2/1935 Blackman ..... 141/137

3,413,097 11/1968 Jungner ..... 141/135

FOREIGN PATENT DOCUMENTS 592745 9/1947 United Kingdom ..... 141/135

*Primary Examiner*—Lawrence J. Staab

*Assistant Examiner*—Michael J. Gonet

*Attorney, Agent, or Firm*—Edward M. Steutermann

[57] ABSTRACT

An arrangement for use in a conveying and filling device where a conveyor is provided which travels along a linear path in a selected direction to carry articles, for example, recepticles to be filled. A dispensing device is carried by a mounting arm located in spaced relation from the conveyor and is carried by crank means to travel in an orbital path where the orbit carries the mounting arm in the direction of movement of the conveyor for the first portion of the orbit at the termination of which the orbital path returns the mounting arm to a second position relative to the conveyor for a second cycle over the conveyor, including a height adjusting arrangement to adjust the clearance between the mounting arm and the conveyor.

7 Claims, 7 Drawing Figures

OSCILLATING HEAD FILLER DEVICE

BACKGROUND OF THE INVENTION

The present invention relates to a device for adjusting the clearance between a mounting arm traveling in an orbital path above a moving conveyor and the conveyor is particularly useful in applications where the mounting arm carries a dispensing device to a fill containers carried by the conveyor.

In operation of such devices the adjustment between the clearance between the mounting arm, the associated dispensing device and the top of the conveyor is critical in that it affects the area over which the material is dispensed and the dispensing pattern.

In other applications the clearance may be critical to avoid fluid splashing out of the containers and loss of the material from the container. Such an occurance is particularly undesirable where in a subsequent operation a lid is applied to the container, for example, by gluing or heat sealing to a flange provided around the periphery of the container and the presence of the material on the lip or flange impairs sealing.

Various prior art arrangements are available for moving a dispensing device with a moving conveyor where containers are carried by the conveyor, however, in known prior art arrangements the clearance adjustment is accomplished manually and requires termination of the operation of the device for adjustment of the clearance.

No prior art arrangement is known providing means for the adjusting the clearance between the dispensing device and articles carried on the conveying line during operation by adjusting the position of a mounting arm which carries a dispensing head. Prior art devices are known where the dispensing head is carried by a servo mechanism carried by the mounting arm but such arrangements are first of all expensive to build and are generally not reliable over an extended period of time so further expense is incurred in lost production time for repair and for maintenance expense.

The ability to adjust the height of a dispensing device above a conveyor is advantageous particularly when the material being dispensed is a liquid where the viscousity of the liquid may vary with time as a result of changes in temperature or changes in composition so that the area over which the material is disposed or the pattern is changed and the clearance between the dispensing device and the recepticals must be frequently adjusted.

SUMMARY OF THE INVENTION

The present invention provides a straightforward, economical arrangement for adjusting the clearance between a mounting arm which can carry a dispensing device, and a conveying line where the mounting arm travels in an orbital path about an axis perpendicular to, and in spaced relation from the axis of travel of the conveying line whereby a first portion of the orbit the mounting arm travels with the conveyor from a first position, then returns to travel with the conveyor in a subsequent cycle.

The present invention provides for adjustment of the clearance between the mounting arm, and the conveyor during operation of the device.

Various prior art arrangements are known where the adjustment of the clearance is accomplished by shutting the line down and manually adjusting the height of the mounting arm, however, such arrangements have been found to be particularly cumbersome, expensive, and undesirable because of lost time in shutting down the line for height adjustment and where several attempts may be necessary to obtain proper adjustment because of the inability to ascertain the effects of the change while the unit is not in operation.

More particularly, the present invention provides an arrangement for use in a conveying and filling device where a conveyor is provided which travels along a linear path in a selected direction to carry articles, for example, recepticles to be filled. A dispensing device is carried by a mounting arm located in spaced relation from the conveyor and is carried by crank means to travel in an orbital path where the orbit carries the mounting arm in the direction of movement of the conveyor for the first portion of the orbit at the termination of which the orbital path returns the mounting arm to a second position relative to the conveyor for a second cycle over the conveyor, including a height adjusting arrangement to adjust the clearance between the mounting arm and the conveyor.

While one example in accordance with the present invention is illustrated in connection with the accompanying drawings, it will be recognized that other arrangements, also within the scope of the present invention, will occur to those skilled in the art upon reading the disclosure set forth hereinafter.

BRIEF DESCRIPTION OF THE DRAWINGS

The one example in accordance with the present invention is discussed herein with reference to the accompanying drawings wherein.

DETAILED DESCRIPTION OF THE DRAWINGS

Figure 1:
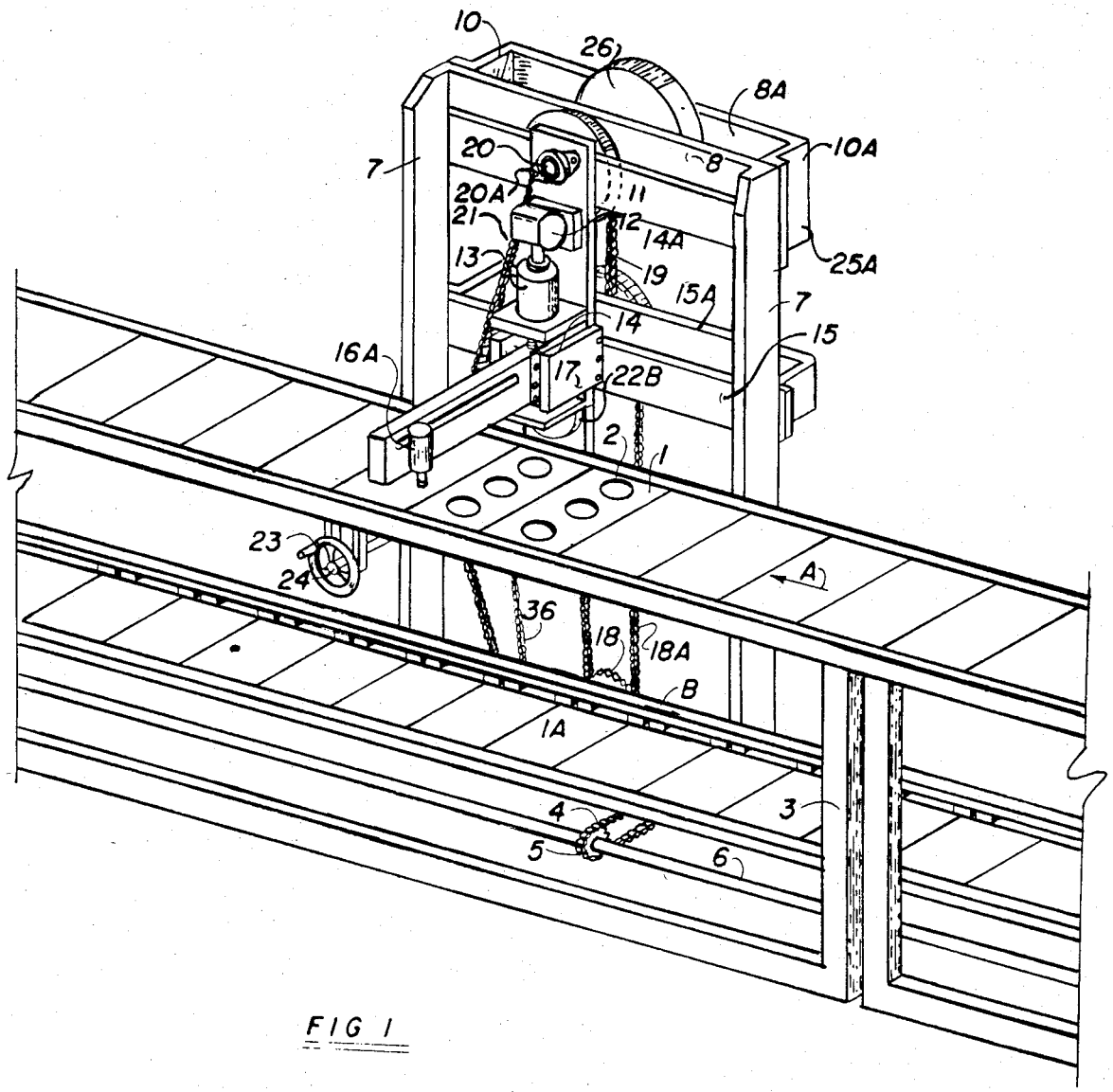
FIG. 1 is a perspective view of the front of a device within the scope of the present invention.
Figure 2:
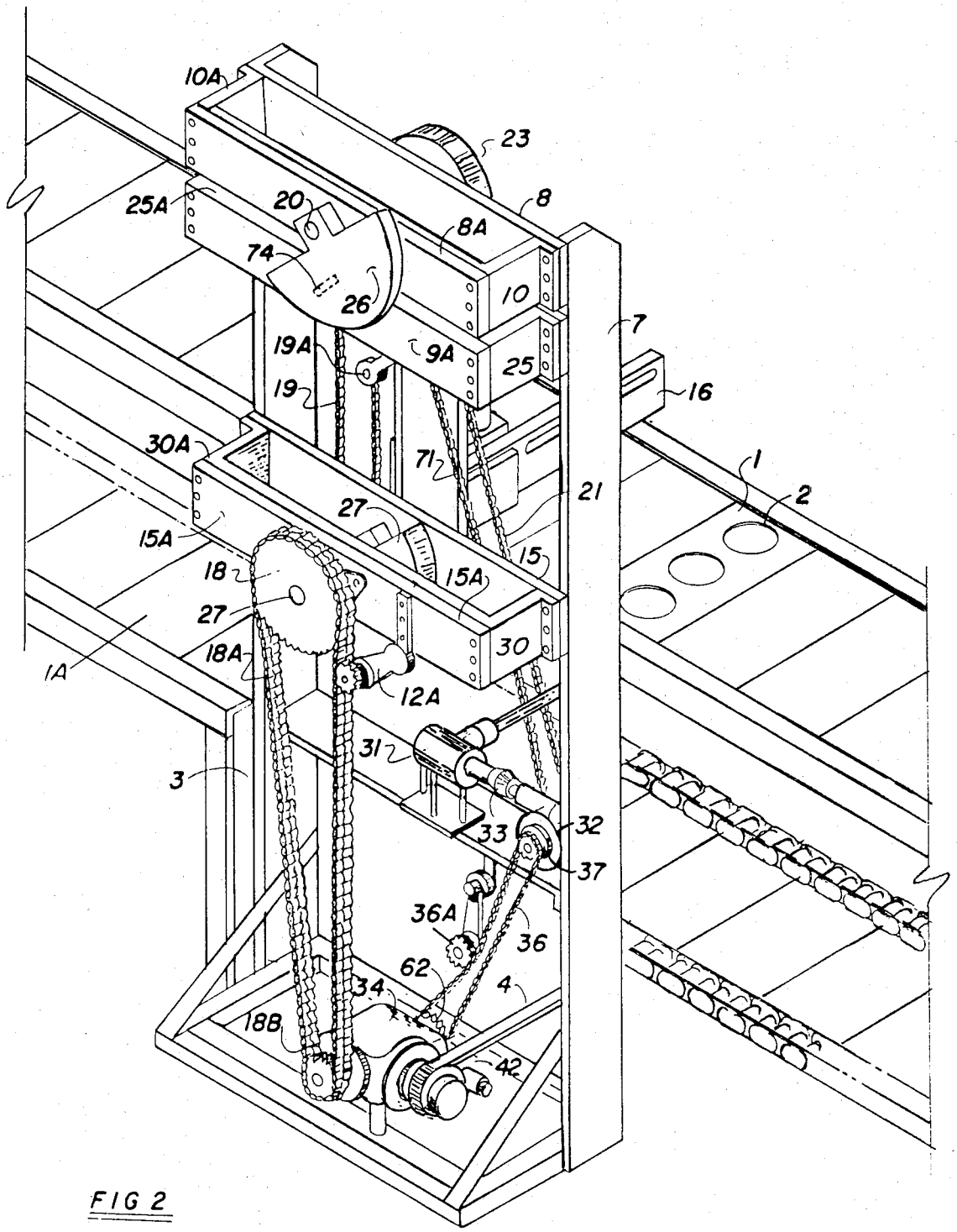
FIG. 2 is a perspective rear view of one example a device within the scope of the present invention.

Referring first to FIG. 1 which illustrates a perspective view of the front side of a unit within the scope of the present invention, a moving conveyor 1 is shown having multiple sections, each including apertures 2 for receipt of, for example, a container to carry a food product. Conveyor 1 moves in a direction illustrated by arrow A at a uniform velocity. Likewise conveyor 1 is carried by a frame 3 and driven by motive means (not shown) and has a return leg 1A. A drive shaft 6, driven by a power source, (not shown) is provided to drive the device within the scope of the present invention as described hereinafter. Drive shaft 6 can be driven by the same motive means as the conveyor so that the conveyor and device within the scope of the present invention are driven at fixed relative rates of speed. A sprocket 5 is provided on shaft 6 to drive, for example, and endless chain 4. Referring to FIG. 2 a drive means 34, for example, a right angle gear box 32 is the dynamic differential provided including an input sprocket 42 driven by chain 4.

A frame 7 is provided having cross members 8, 9 and 15 with spaced cross members 8A, 9A, 15A which are carried by brackets 10, 10A, 25, 25A, 30, 30A as shown in FIG. 2 and adapted to receive the mechanism described hereinafter, therebetween to adjust the position of a mounting arm 16 above conveyor 1.

As described hereinafter in more detail, mounting arm 16 moves in orbital path having an axis transverse to and in spaced relation above the path traveled by conveyor 1. Advantageously, in the first portion of the orbit where the mounting arm is closest to conveyor 1 the mounting arm moves with the conveyor 1 in the direction illustrated by the arrow A (FIG. 1) and for a portion of the time moves at a speed nearly equivalent to the velocity of conveyor 1.

In one arrangement the speed of arm 16 approximates the speed of conveyor 1 when arm 16 is at the bottom of its orbit.

In this arrangement, arm 16 does not move significantly faster than conveyor 1 even at the bottom of the orbit.

In another arrangement the drive elements are selected so that the linear components of the speed of arm 16 parallel to conveyor 1 is equal to the speed of conveyor 1 just before and just after bottom center where the arm 16 is closest to conveyor 1 and the linear speed component is selectively greater than the speed of conveyor 1.

It has been found that in this manner, the effective dwell line of arm 16 can be increased particularly where arm 16, for example, initially aligns itself with a position selectively near the rear edge of a container on conveyor 1 then moves from the rear of the container to near the front of the container as arm 16 moves faster than conveyor 1 and finally reduces speed to equal the speed of conveyor 1 as the arm approaches the front end of the conveyor.

The mounting arm then returns through a second portion of the orbit to the point where the first portion again commences.

As shown, a hand wheel 23 is provided connected for rotation of a shaft 24 as described hereinafter for adjustment of the clearance between mounting arm 16 and the top of conveyor 1. As further shown in FIG. 1 mounting arm 16 can be adapted to carry dispensers 16A, only one being shown, but it being understood that multiple dispensers are usually provided and depending upon the speed of rotation of mounting arm 16 two or more distributors in line may be provided. In the example shown, three dispensers across would be provided to adequately serve the containers provided in each of the apertures 2. Mounting arm 16 is carried within guide members 17 for vertical adjustment therebetween. As hereinafter described, the height of mounting arm 16 is adjustable relative to conveyor 1 by means of rotation of a threaded shaft 14 which is received in a threaded fitting carried by mounting arm 16 (not shown) so that mounting arm 16 is raised and lowered depending on the direction of rotation of shaft 14. A coupling 13 is provided to connect shaft 14 to a right angle angle drive 12, which is carried by an oscillating arm 11 as are guides 17 which carry mounting arm 16 which moves with arm 11.

Figure 3:
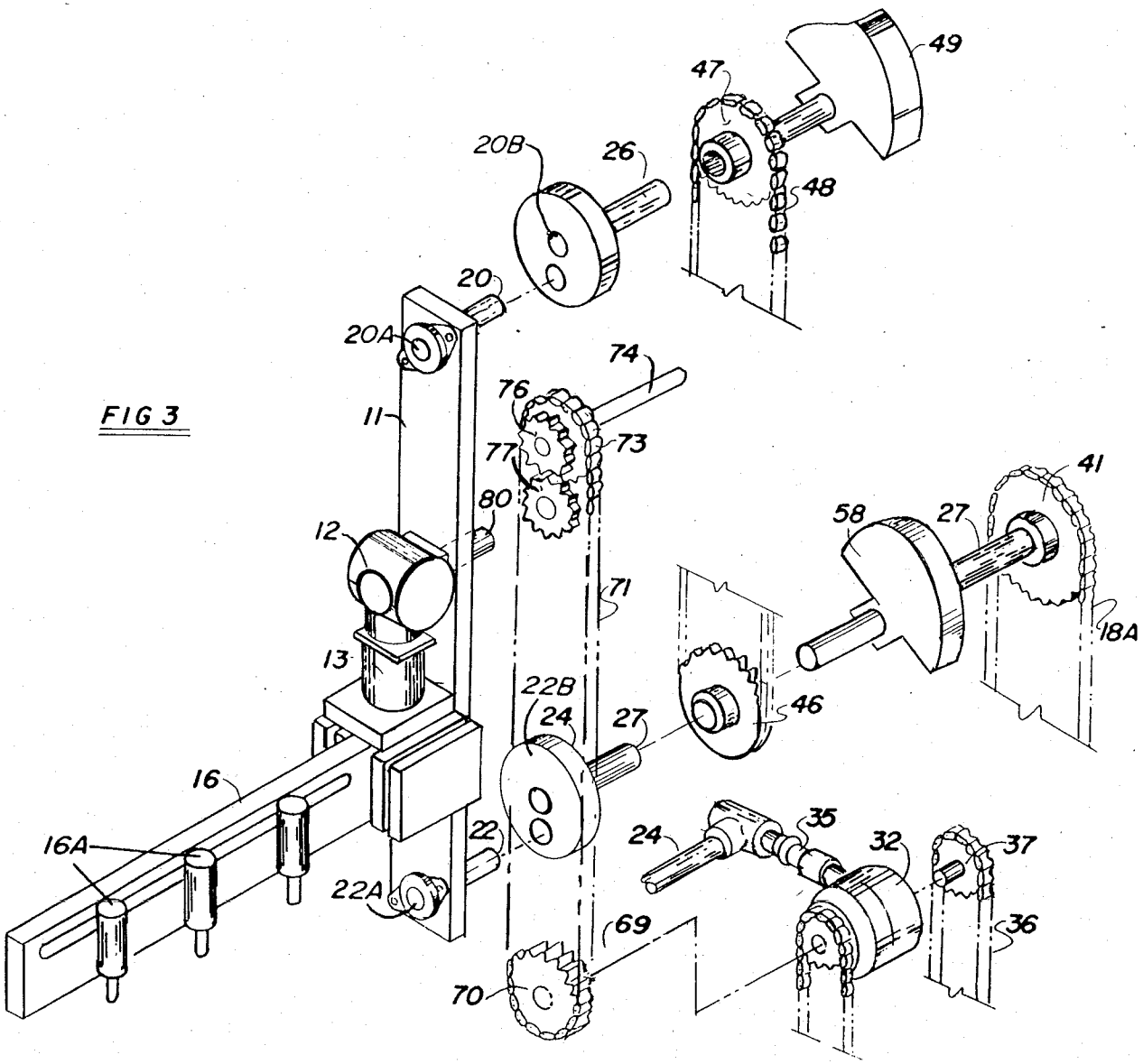
FIG. 3 is a schematic illustration of a drive mechanism in accordance with the present invention for the device shown in FIGS. 1 and 2.

Referring to FIGS. 1, 2 and 3, in relevant position which illustrate the location and configuration of elements which make up and drive the oscillating arm 11, arm 11 is provided with journals 20A and 20B to receive pivots 20 and 22 carried eccentrically by crank wheels 22A, 22B rotated at the same rate of travel by shafts 26, 27. Arm 11 travels in an orbital path by rotation of wheel 23 and shaft 24 which are cooperatively positioned for such movement and carries mounting arm 16 in an orbital path above conveyor 1 and the direction of travel of conveyor 1 for a first portion of the orbit that dispenser 16A can be actuated to deposit fluid on recepticles carried in operations. Actuation of dispensers 16A can be accomplished by various means known in the art. In one arrangement (not shown) the dispensers are actuated during a selected portion of the orbital path of arm 11 and usually during the portion of the orbit when arm 11 is at the lowest position.

As shown in FIG. 1 horizontal cross member 8 is provided to journal shaft 26 and shaft 27 is journaled in cross member 15. A drive means, for example a sprocket 18, as shown in FIGS. 1, 2 and 3 is provided by drive 34 for rotation of an endless chain 18A, as described hereinafter. Chain 18 drives a sprocket 41, as shown, which drives shaft 27 and crank 22B. A sprocket 46 is provided on shaft 27 and connected to drive a sprocket 47 carried by shaft 26 by means of an endless chain 19 to assure uniform rotation of cranks 22A and 22B.

Counterweights 49 and 58 are provided to be carried by shafts 26 and 27 to offset the weight of mounting arm 16 and any appurtenances as best shown in FIGS. 2 and 3.

Accordingly, rotation of shaft 27, at a speed determined by the speed of rotation of shaft 6, the configuration of drive 34 and the relative sizes of the chain sprockets determine the orbital speed of arm 16 where it is desirable that the speed in the first portion of the orbit be generally equal to the speed of conveyor 1.

As shown, gearbox 34 is provided with a second output sprocket 62 to drive a chain 36 where a tensioning device 36A is provided to maintain the tension of chain 36 where chain 36 drives one input sprocket 37 of a planetary differential gear drive 32 described hereinafter having a second input shaft 33 connected through an angle gear drive 31 to shaft 24 which is rotated by wheel 23 as previously described. An output shaft 69 (shown in FIG. 3) is provided to drive a sprocket 70 and chain 71 as shown.

Chain 71 drives a sprocket 73 carried by a shaft 74 where sprocket 73 carries a gear wheel 76. A second gear wheel 77 is provided to mate with gear wheel 76 and is carried by an shaft 80 of angle drive 12.

Planetary differential 32 can, for example be of the type manufactured by Hart Design & Manufacturing Co. Inc. of Green Bay Wis. Such a device has a first input shaft 33, a second input sprocket 37 and an output shaft 69 to drive sprocket 70. As is known in the art, the internal construction (not shown) of such a device generally consists of helical gear planatary means. Ordinarily one shaft extension transmission is secured to the spider of the the helical gear plantary. Pinions or planets mounted on ball bearings located in the spidering engage one sun gear referred to as the output gear where the output gear is secured to a shaft which is part of the second shaft extension. A normally stationary sun gear referred to as the held gear is located such that the second set of pinions or planets are engaged with the held gear. Because the held gear is secured to the worm gear in normal operation, neither will rotate but will be held in fixed position due to the engagement of the worm gear with the worm. In this case the worm is secured to the shaft 33 and prevents creep or accidental rotation of the handwheel shaft. The planetary gears can be selected with the proper number of teeth to provide a one to one direction of rotation with respect to the direction of rotation of the shaft. That is exactly one revolution of the input shaft in one direction will result in exactly one revolution of the output shaft in the opposite direction or a negative direction of rotation. However rotation of the shaft in the opposite direction will result in a positive direction of rotation. In one example of a planetary differential as used in the present invention, the worm gear is selected such that one revolution of the hand gear will result in for example, 12° rotation of the output shaft with respect to the input shaft where the extent of rotation of the output shaft is the sum of the rotation of the rotating input shaft, in this case driven by sprocket 37 and the adjustment shaft. Thus in operation sprocket 37 is rotated by chain 36 from gearbox 34 (FIG. 2) which is drawn from conveyor drive shaft 6 as previously described. Without adjustment of shaft 35, sprocket 70 rotates at a given rate. However adjustment of shaft 35 causes an arcuate advance or retreat of sprocket 70 relative to the rotation of sprocket 37 and directly affects the position of gear wheel 72 on gear wheel 76 as described hereinafter.

As can be seen from the drawings, gear wheel 77 is carried by rotatable shaft 80 which provides the input for right angle gear 12. Shaft 74 is journaled in cross members 9, 9A and the centerline spacing between shafts 74 and 80 is selected to allow continuous mesh of gear wheels 76 and 77. Further, speed of rotation and sprocket sizes and sizes of gear wheels 76, 77 are selected so that as arm 11 orbits as result of cooperative rotation of cranks 23, 24 gear 77 orbits around gear wheel 76 at the same speed as the speed of rotation of gear 76 when there is no adjustment of wheel 23 so there is no rotation of shaft 80. As previously described shaft 80 by means of angle drive 12 causes rotation of threaded shaft 14 which raises or lowers mounting arm 16 depending on the direction of rotation of shaft 80. Shaft 80 is rotated when the arc through which gear wheel 76 rotates is different than the arc through which orbiting gear wheel 77 passes. The difference occurs as previously described, when shaft 24 is turned to introduce an incremental change in the arc of rotation of output shaft 69 apart from the arc of rotation normally provided by rotation of input sprocket 37.

Since the speed of rotation of sprocket 37 is proportional to the speed of shaft 6 and the speed of rotation of cranks 23 and 24 is likewise determined by the speed of shaft 6, the interconnecting drive trains are selected so that gear wheel 77 orbits gear wheel 76 so that shaft 80 does not rotate except when shaft 24 is adjusted. The arcuate travel of gear wheel 76 is adjusted and rotates gear wheel 77 as described hereinafter.

Further in accordance with the present invention, it will be understood that while the principal drive for the device described hereinbefore and hereinafter is from the drive shaft of the conveyor, other drive means could be provided, it only being necessary that synchronization and indexing of the various elements of the device be maintained by means of proper selection of, inter alia, speed, sprocket diameters and gear transmission ratios.

In operation, with conveyor 1 running, drive chain 4 rotates sprocket 42 to provide input drive to gearbox 34. Output sprocket 18 rotates chain 18A which in turn rotates sprocket 41 and shaft 27 thereby rotating sprockets 46, 47 (by means of chain 48) and cranks 22A, 23A at the selected speed to provide the orbital motion of arm 11 and mounting arm 16. As previously described counterweights 49 and 50 are provided on shafts 26 and 27 to balance the weight of the mounting arm 16 and its associated elements including various dispensers 16A which may be carried thereby.

Sprocket 62 of gear box 34 drives differential 32 by means of chain 36. An output sprocket 70 is provided from planetary differential 32 to drive chain 71.

As previously described, the rotation of chain 71 is determined by the speed of rotation of sprocket 70 and the rotation, if any, of shaft 24 where the rotation is transmitted through angle gear box 31 and shaft 33. So long as there is no rotation of shaft 24 then advantageously chain 71 rotates at a speed sufficient to provide no rotation of shaft 80 because gear wheel 77 orbits around gear wheel 76 at the speed of rotation of wheel 76, so the contact point between gear wheels 76 and 77 remains static until rotation of shaft 24 as described hereinafter.

FIGS. 4A–4D are schematic illustrations of the operation of the adjusting means utilized in adjusting the height of mounting arm 16 above conveyor 1.

Figure 4A:
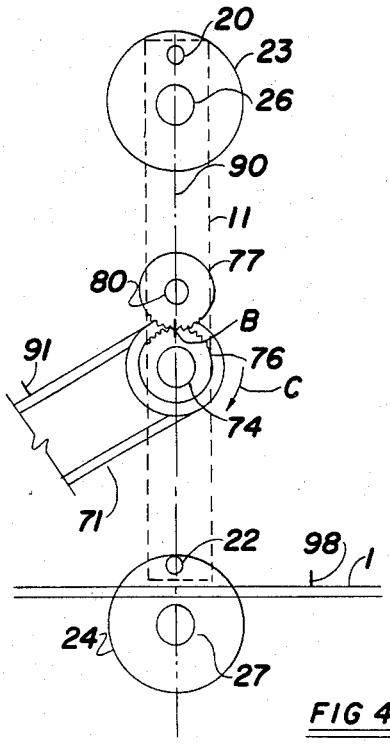
FIGS. 4A–4D are sequential illustrations of the operation of the device shown in FIGS. 1–3.

More particularly, in FIG. 4A cranks 23–24 are shown with arm 11 connected therebetween. It will be understood from the previous discussion that cranks 22A and 22B are rotated by means of shafts 26 and 27 where arm 11 is connected at opposite ends to cranks 22A and 22B by pivots 20 and 22 respectively.

In FIG. 4A the device is shown with the cranks 22A, 22B in a position where pivots 20 and 22 are in aligned relation along a center line 90. It will be noted for reference purposes the contact point between gear wheels 77 and 76 is noted by the reference numeral B. At the position shown in FIG. 4A chain 71 has a relative reference point 91 (the position of a selected point of chain 71). Likewise a reference point 98 is shown on conveyor 1.

Figure 4B:
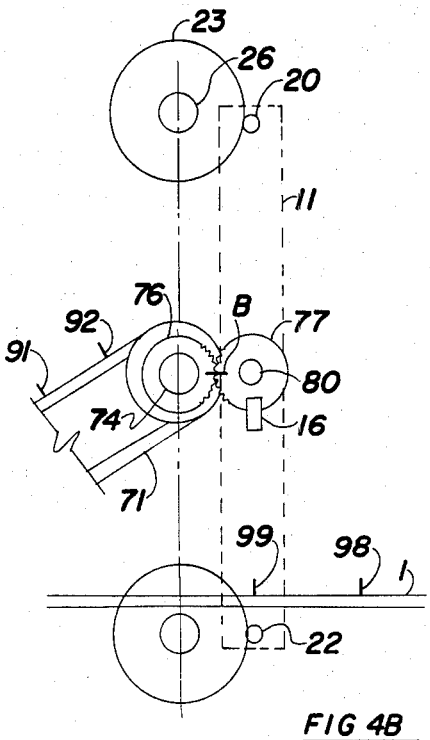

In FIG. 4B cranks 22A, 22B have turned through a one quarter revolution so that gear wheel 77 is shown in the clockwise 90° position where it will be noted that the gear wheel 76 and 77 are still in contact at reference B. Chain 71 has moved from reference point 91 to reference point 92 and conveyor 1 has moved from reference point 98 to reference point 99.

Figure 4C:
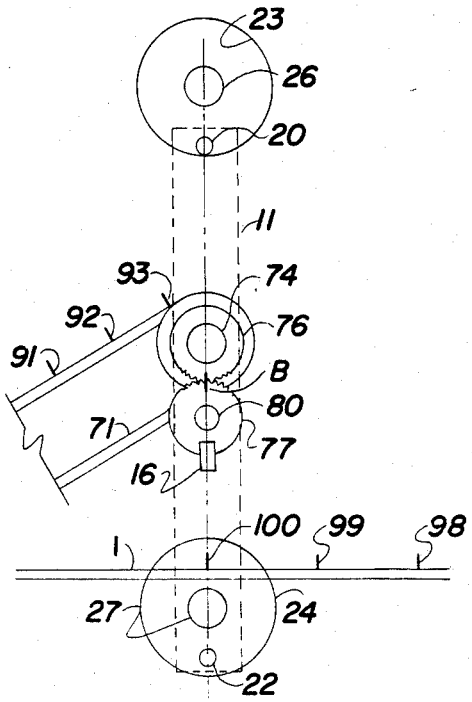

In FIG. 4C cranks 22A and 22B have rotated through an additional 90° arc in a clockwise direction and once again are in aligned relation on centerline 90 but with arm 16 at the low point of the orbit. Chain 71 has progressed from position 92 to position 93 rotating wheel 76 a like amount where gear wheel 77 has likewise rotated through 90° so wheels 76 and 77 are still in contact at point B. Likewise conveyor 1 has progressed to reference point 100.

Figure 4D:
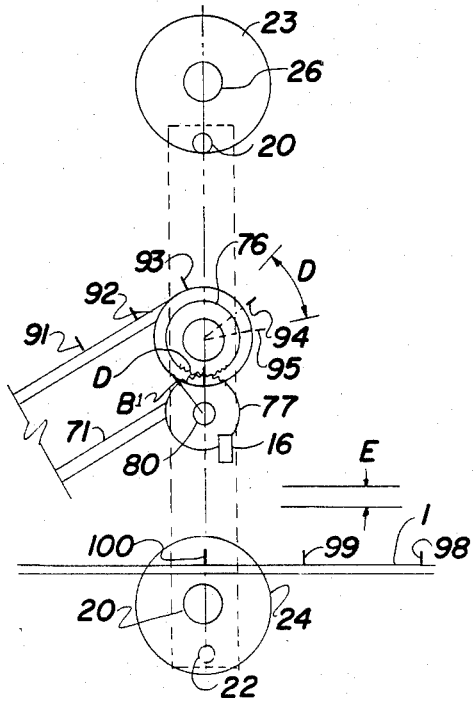

FIG. 4D illustrates the effect of rotation of shaft 24 while the arrangement is in the position shown in FIG. 4C. In FIG. 4D shaft 24 (not shown) has been rotated an amount sufficient to rotate wheel 76 through an arc D so that wheel 77 and shaft 80 are likewise rotated through an arc D and the previous contact point B has now been rotated to point B'. In connection with previous described it has been disclosed that rotation of shaft 80, carried by gear wheel 77, connected through right angle drive 12 causes rotation of shaft 14 which raises or lowers arm 16. Accordingly, as shown in FIG. 4D the rotation of gear wheel 76 through the additional arc D has rotated shaft 14 to lower the bottom of arm 16 from point F to point G through a distance E.

It will be understood that rotation of shaft 24 in the opposite direction would raise arm 16. It will be understood that the adjustment described with reference to FIGS. 4C and 4D can be made while the previously described device is rotating.

It will be understood that the foregoing is but one example of an arrangement and application of devices within the scope of the present invention and that various other arrangements and applications will likewise occur to those skilled in the art upon reading the disclosure set forth hereinbefore.

The invention claimed is:

1. A device for adjusting the spacing between a mounting arm and a conveyor traveling linearly parallel to a first axis at a selected speed where the mounting arm moves in an orbital path in a plane parallel to the first axis and about a second axis transverse to the first axis in spaced relation from the conveyor so the linear component of speed of the mounting arm parallel to the direction of travel of the conveyor is directed opposite to the direction of travel during a first portion of the orbit and in the same direction of travel as the conveyor during a second portion of the orbit including:

a. crank drive means having a drive shaft to rotate eccentric crank means and an eccentrically located post connected to the mounting arm to drive the mounting arm in an orbital path in a plane parallel to the first axis;

b. a planetary differential gear device having a first input shaft and an adjustment input shaft and a differential output shaft which rotates through an arc instantaneously responsive to the rotation of the first input shaft and to be selectively advanced by rotation of the adjustment input shaft in a first direction and retarded by rotation of the adjustment input shaft in a second direction;

c. first adjustment drive means including a shaft rotatable about a fixed axis at a selected speed of rotation and having a first circular external drive surface;

d. power transmission means to interconnect the differential output shaft for rotation of the first adjustment drive means;

e. second adjustment drive means carried by the mounting arm means for orbital travel therewith having a second circular external drive surface to engage and be in continuous contact with said first external drive surface and where the second adjustment drive means has a rotatable output shaft;

f. first drive means to drive the conveyor;

g. second drive means to rotate the drive shaft of the crank drive means and the first input shaft of the planetary differential gear device so that without rotation of the adjustment input shaft the arc of rotation of the first circular external drive surface is equal to the arc of rotation of the second circular external drive surface so there is no relative movement of the second adjustment drive means about the first adjustment drive means and so that upon rotation of the adjustment input shaft of the planetary differential gear device the first circular external drive surface rotates relative to the second circular external drive surface to rotate the rotatable output shaft through an arc proportional to the extent of rotation of the adjustment input shaft and in a direction determined by the direction of rotation of the adjustment input shaft;

h. space adjusting means connected to said mounting arm and having a space adjusting input shaft driven by the rotatable output shaft to adjust the position of a portion of the mounting arm relative to the conveyor dependant upon extent and direction of rotation of the rotatable output shaft of the second adjustment drive means.

2. The invention of claim 1 wherein said crank drive means includes first and second crank means located in spaced relation to each other and in spaced relation from said conveyor where said first and second crank means include respectively, first and second driven shafts to rotate the associated crank means and first and second pivot means mounted eccentrically respectively from the first and second drive shafts and bracket means connected adjacent opposite ends to the first and second pivot means and where the space adjusting means is carried by said bracket means and said mounting arm is carried by said space adjusting means.

3. The invention of claim 1 wherein said first and second external drive surfaces are gear teeth which mutually mesh at said contact point.

4. The invention of claim 2 wherein said space adjusting means includes rotatable threaded shaft means rotated by said output shaft and where said mounting arm includes threaded aperture means to threadably receive said rotatable threaded shaft so said mounting arm is moved relative to said bracket means and said conveyor means by rotation of said rotatable threaded shaft.

5. The invention of claim 2 wherein said first and second driven shafts each includes sprocket means, drive linkage means provided between said sprocket means whereby rotation of said first shaft causes rotation of said second shaft at the same rotational speed as said first driven shaft.

6. The invention of claim 1 wherein the crank drive means drives said mounting arm in said orbital path so the linear component of the speed of said mounting arm during said second portion of said orbit is generally equal to the linear speed of said conveyor when the orbital path of said mounting arm takes said mounting arm closest to said conveyor means.

7. The invention of claim 1 wherein the crank drive means drives said mounting arm in said orbital path so the linear component of the speed of said mounting arm during said second portion of said orbit is generally equal to the linear speed of said conveyor a selected first location before and a selected second location after the orbital path of said mounting arm takes said mounting arm closest to said conveyor and where the linear component of the speed of said mounting arm parallel to the direction of travel of said conveyor is greater than the linear speed of said conveyor between said first and second locations.

* * * * *